US007310494B2

(12) United States Patent
Fahmy et al.

(10) Patent No.: US 7,310,494 B2
(45) Date of Patent: Dec. 18, 2007

(54) DEVELOPING AGENT TRANSPORT AND STORAGE

(75) Inventors: Alfred Louis Fahmy, Lexington, KY (US); Robert Watson McAlpine, Lexington, KY (US); Franklin Joseph Palumbo, Nicholasville, KY (US); William Dale Smith, Georgetown, KY (US); Donald Wayne Stafford, Georgetown, KY (US); Gregory Scott Tigges, Frankfort, KY (US)

(73) Assignee: Lexmark International, Inc., Lexington, KY (US)

( * ) Notice: Subject to any disclaimer, the term of this patent is extended or adjusted under 35 U.S.C. 154(b) by 100 days.

(21) Appl. No.: 11/215,340

(22) Filed: Aug. 30, 2005

(65) Prior Publication Data

US 2007/0048050 A1 Mar. 1, 2007

(51) Int. Cl.
*G03G 21/12* (2006.01)

(52) U.S. Cl. ..... 399/360

(58) Field of Classification Search ..... 399/99, 399/101, 120, 358, 360
See application file for complete search history.

(56) References Cited

U.S. PATENT DOCUMENTS 5,030,988 A * 7/1991 Haneda et al. ..... 399/358 X
5,146,270 A * 9/1992 Matsuo et al. ..... 399/358 X
5,170,209 A 12/1992 Tompkins et al.
5,250,989 A * 10/1993 Morita et al. ..... 399/358 X
5,398,102 A 3/1995 Wada et al.
5,563,691 A 10/1996 Hayakawa et al.
5,576,820 A 11/1996 Hagihara et al.
5,778,296 A * 7/1998 van der Steen et al. .... 399/360
5,933,696 A * 8/1999 Howard et al. ..... 399/360
5,950,062 A 9/1999 Yahata et al.
6,157,807 A 12/2000 Takenouchi et al.
6,484,008 B2 11/2002 Arcaro et al.
6,522,851 B2 2/2003 Stickler
6,546,225 B2 4/2003 Wang
6,775,498 B2 8/2004 Palumbo et al.
2004/0005179 A1* 1/2004 Byun et al. ..... 399/358

* cited by examiner

*Primary Examiner*—Sandra L. Brase
(74) *Attorney, Agent, or Firm*—Grossman, Tucker, Perreault & Pfleger, PLLC

(57) ABSTRACT

An apparatus and method for the transport and/or storage of developing agent in an image forming apparatus. A cartridge may be employed having a reservoir for developing agent and a component, such as a drum, which may include an interior region capable of storing developing agent. A transport device may be included that is capable of transporting developing agent between the reservoir and a location in the image forming apparatus such as the drum interior.

20 Claims, 5 Drawing Sheets

DEVELOPING AGENT TRANSPORT AND STORAGE

FIELD OF INVENTION

The present invention relates the transport and/or storage of developing agent within an image forming apparatus. The image forming apparatus may include printing devices such as inkjet printers, electrophotographic printers, copier, faxes, all-in-one devices or multi-functional devices.

BACKGROUND

A cartridge may be used in a number of image forming systems, such as electrophotographic devices. In the cartridge a developing agent, such as toner, ink or other image forming substance may be transferred onto a supply roll from a supply reservoir. The developing agent may then be transferred to a developer, such as a developer roll, from the supply roller. The developing agent may then be metered onto the developer using a metering device. From the developer, the developing agent may be transferred selectively onto a photoconductor, such as a photoconductive roll or drum. The developing agent may then be transferred from the photoconductor to a sheet of media.

Residual developing agent, such as developing agent that may remain on the photoconductor, may be removed from the photoconductor surface by a cleaning device. Once removed by the cleaning device, the residual developing agent, such as toner, may be transferred to a waste toner storage reservoir.

SUMMARY

The present invention relates to an apparatus and method for the transport and/or storage of developing agent in an image forming apparatus. A cartridge may be employed comprising a reservoir for developing agent and a component, such as a drum, which may include an interior region or cavity capable of storing developing agent. A transporting device may be included that is capable of transporting developing agent between the reservoir and a location within the image forming apparatus, such as the drum cavity. The transport device may be, for example, an auger, that may be engaged with the drum. Rotation of the drum may then rotate the auger which may then transport image forming material between the reservoir and drum interior.

DETAILED DESCRIPTION

Figure 1:
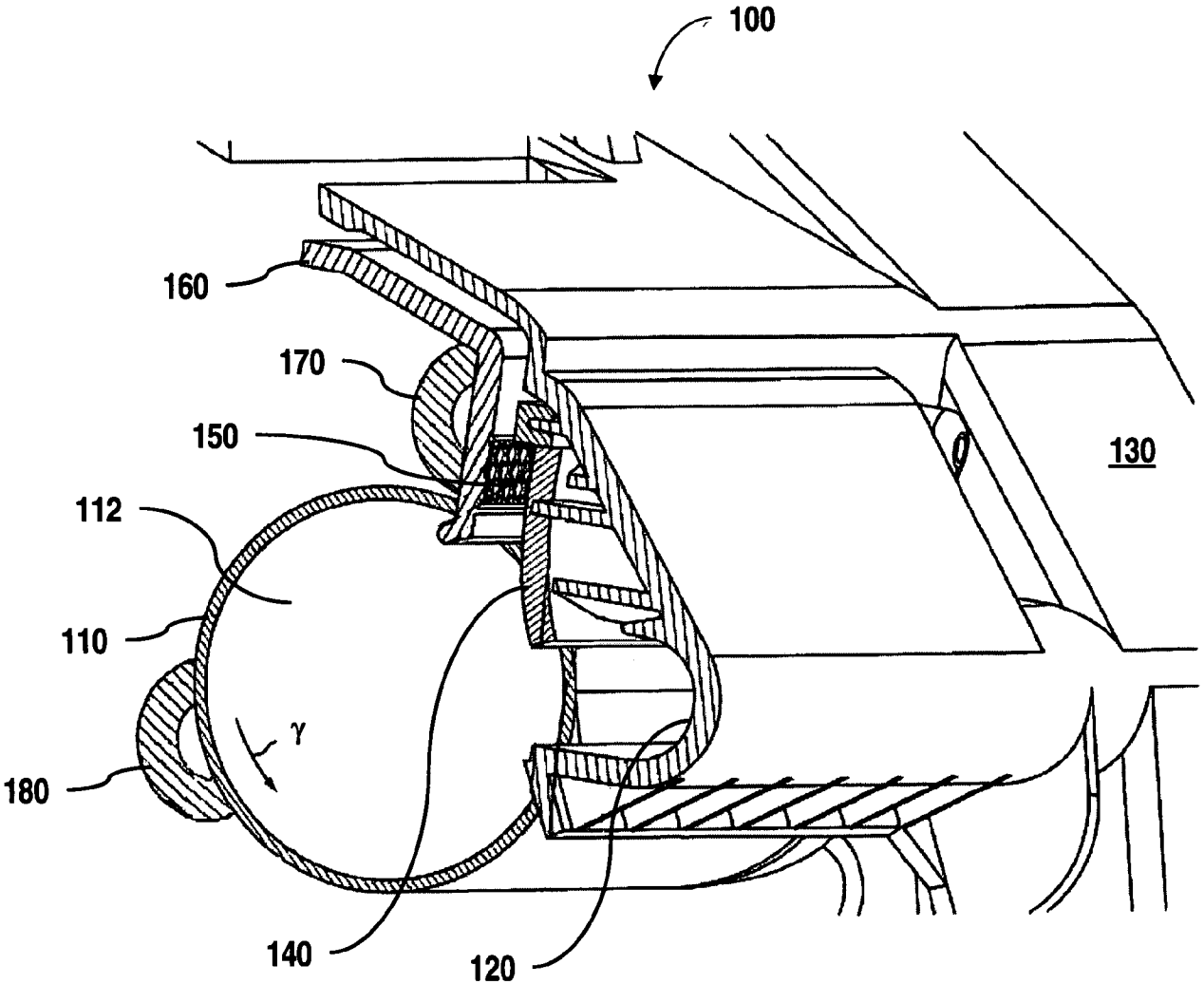
FIG. 1 is a partial perspective view of an exemplary embodiment of a cartridge device including a channel and reservoir.

Illustrated in FIG. 1 is a portion of a cartridge 100. The cartridge may be located in an image forming apparatus. The cartridge may be removed from the image forming apparatus. A photoconductor 110 may be incorporated into the cartridge 100. As illustrated, the photoconductor 110 may be in the form of a drum. A channel 120 may be located proximate to the photoconductor drum 110 and may extend across to the side wall of the process device 100 to a reservoir 130.

Residual developing agent may be removed from the photoconductor drum 110 using, for example, a blade 140. Blade 140 may be attached to mounting surface 150 on bracket 160 or attached directly to the bracket 160 and may extend outward to contact the photoconductor 110. As the photoconductor 110 rotates, such as in direction y, the blade 140 may remove the waste toner from the surface of the photoconductor 110.

Positioned adjacent to the blade 140 and photoconductor drum 110 may be a channel 120 to capture the waste developing agent removed from the photoconductor drum 110 after a print cycle. The developing agent may then be displaced from the channel 120 into the reservoir 130 by a conveying device such as an auger (not illustrated) or any other device including slides, chutes, and/or vibrating surfaces that may direct the waste developing agent into the reservoir 130. The reservoir 130 may provide space for storing developing agent.

Figure 2:
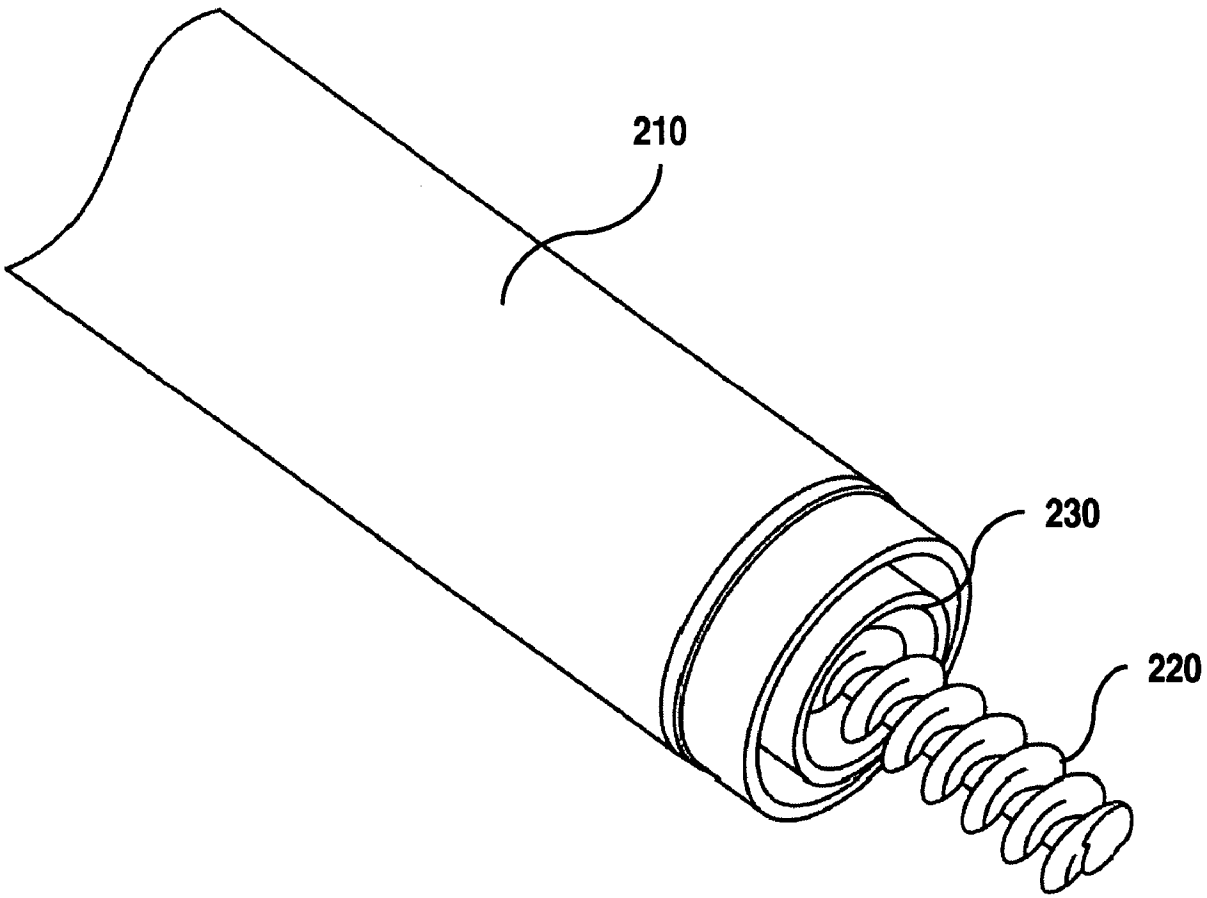
FIG. 2 is a perspective view of an exemplary embodiment of a drum of the present invention.

In one embodiment of the present invention storage for developing agent may be provided for inside of a component such as the cavity 112 within the photoconductive drum 110, which may be understood as one example of moving component as it may rotate during operation of the image forming device. Illustrated in FIG. 2 is a drum 210 which may therefore be the photoconductor drum 110. However, any component that may provide an interior space for developing agent may be utilized in the present invention, including moving components such as the charge roller 170 for charging the surface of the photoconductor, supply roller 180, etc. A transporting device 220 such as an auger, a slide, chute, and/or vibrating surface may be inserted into the drum 210 and may pass through a tube 230 that may also be located within the drum 210.

Figure 3:
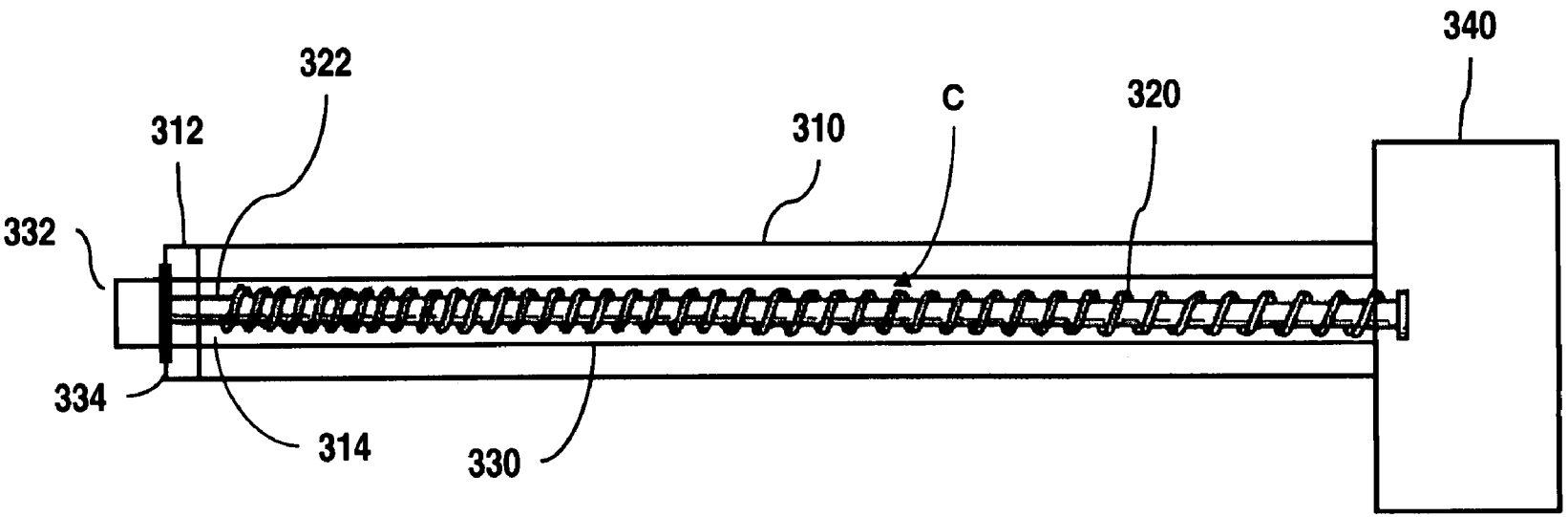
FIG. 3 is a cutaway view of an exemplary embodiment of a portion of a photoconductor and a reservoir in an image forming apparatus.

Illustrated in FIG. 3, the drum 310 may include an endcap 312 that may be pressed into an end of the drum 310. The shaft 322 of the transport device 320 may be keyed to rotate with the endcap 312 and therefore rotate along with the drum 310. The tube 330 as a hollow structure may extend the length of the drum 310 and may provide an axle 332 on which the drum endcap may engage. Furthermore, a seal 334 may be placed at the end of the tube 330 to prevent the developing agent from leaking. The transport device 320 may extend into the reservoir 340. It can be appreciated that in this particular example, movement of the drum 310 in the manner in which the drum rotates during a print cycle conveniently transports developing agent from reservoir 340 into the tube cavity 314.

Figure 4A:
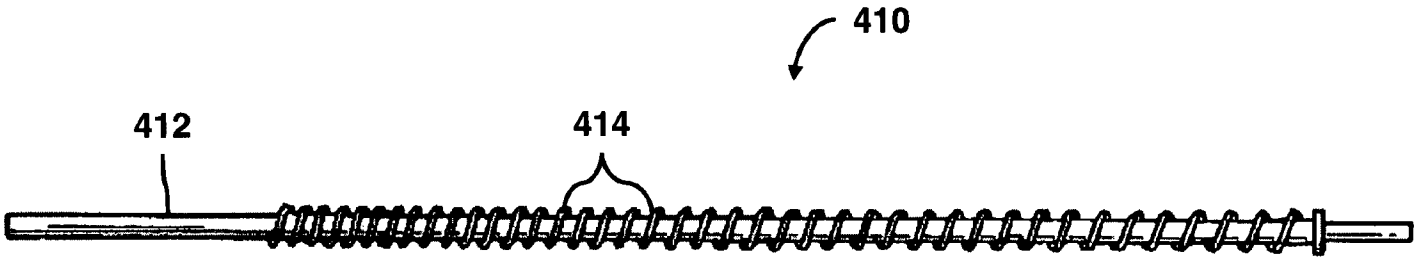
FIGS. 4*a* and 4*b* are exemplary embodiments of an auger.
Figure 4B:
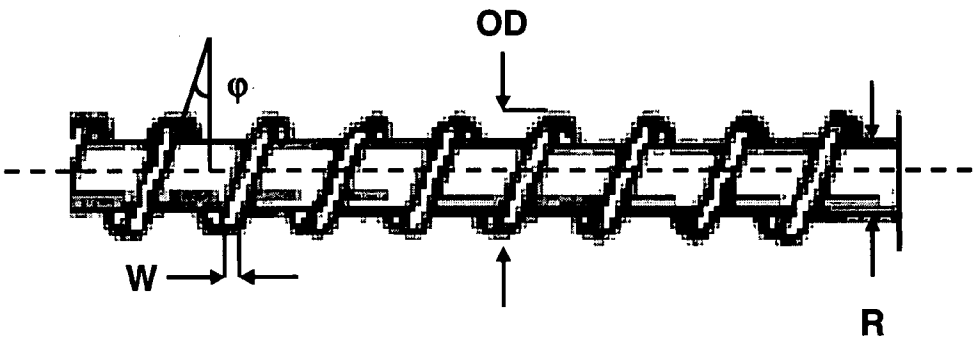

An exemplary embodiment of an auger is illustrated in FIGS. 4*a* and 4*b*. The auger 410 may include a shaft 412 keyed to rotated with the endcap 312 (illustrated in FIG. 3). The auger may include a plurality of flights 414 that may extend from the shaft 412. The flights may be located along all or a portion of the shaft. The flights may be a continuous flight body (illustrated in FIG. 4) spiraling around the shaft or may be a series of flight segments spaced around and/or along the shaft 412 (not illustrated).

Furthermore, the auger 410 may also have substantially the same or a varying outer diameter OD and root diameter R along the length of the shaft 412. The auger may also have varying flight widths W or helix angles (p. A helix angle may be a reference to the approximate angle of a flight perpendicular to the axis of the shaft 412. The auger 410 may also have substantially the same clearance C between the flights and the tube in which the auger may rotate (illustrated in FIG. 3), or the clearance C may vary along the length of the shaft 412.

Figure 5:
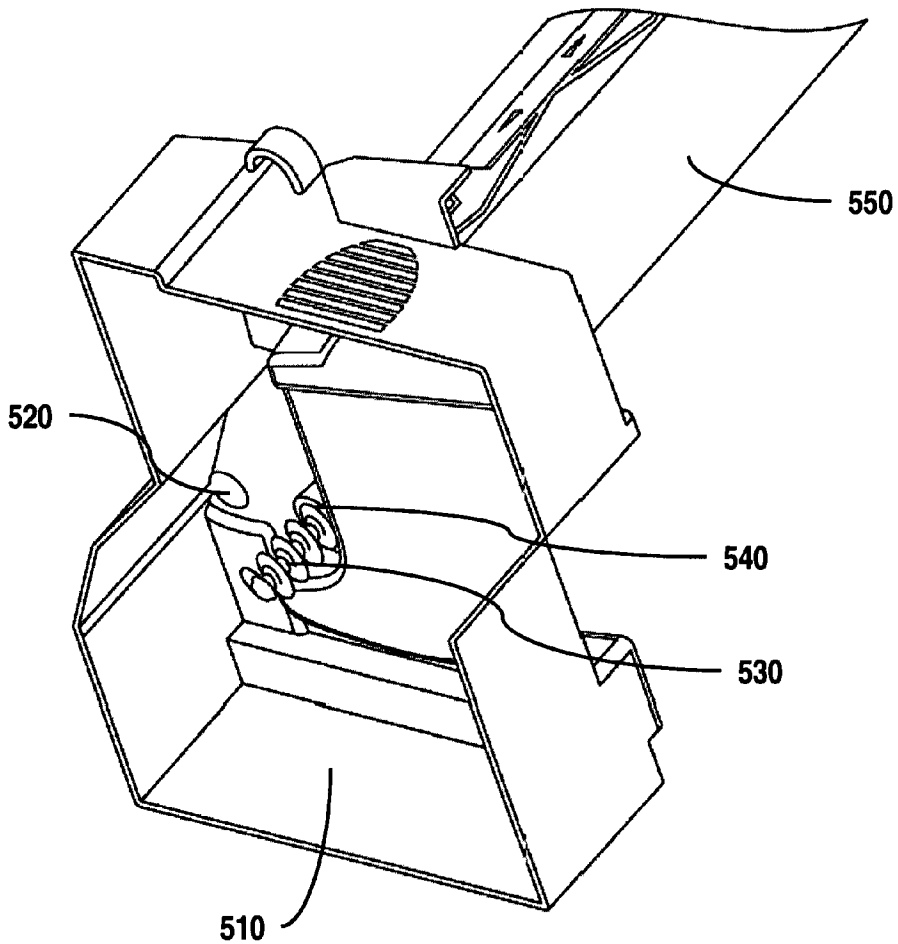
FIG. 5 is a partial perspective view of an exemplary embodiment of a photoconductor and a reservoir.

Accordingly, as illustrated in FIG. 5, residual developing agent may enter the reservoir 510 from the channel 520. The transport device 530 may extend into the reservoir 510 from the tube 540. The tube 540 may be fit into the reservoir or fitted with a seal (not illustrated) in such a manner so as to prevent leakage of the developing agent from the cartridge. The transport device 530 may transfer the developing agent from the reservoir 510 into the drum 550 as the conveying device 530 is rotated. The clearance C (illustrated in FIG. 3) between the transport device 530 and the tube 540 may be varied per the conveyance characteristics of the developing agent, which may pack into the drum 550. As the drum 550 rotates, the developing agent, such as waste toner, may be distributed along its length and stored within the drum 550.

As can be seen from all the above, the present invention relates to the transport and storage of developing agent in an image forming apparatus. The transport may occur between a development agent reservoir and a cavity within a component, which may be a moving component (e.g. a drum or roller). The reservoir may contain waste developing agent. The component may be incorporated in a cartridge that may be removed from the image forming apparatus. The image forming apparatus may be capable of forming images on media, such as paper, cardstock, envelopes, labels, transparencies, etc., in addition to having other capabilities. An image forming apparatus may therefore include printing devices such as inkjet printers, electrophotographic printers, copier, faxes, all-in-one devices or multi-functional devices. Developing agent may include toner or ink or any other image forming substance.

The foregoing description is provided to illustrate and explain the present invention. However, the description hereinabove should not be considered to limit the scope of the invention set forth in the claims appended here to.

What is claimed is:

1. A cartridge for an image forming apparatus comprising:

a moving component including an end cap having a cavity capable of containing developing agent;

a reservoir for developing agent;

a transport device having a shaft keyed to rotate with said endcap and capable of transporting developing agent between said reservoir and cavity of said moving component; and wherein upon rotation of said moving component including said end cap and said shaft keyed to rotate with said end cap said rotation activates said transport device to transport said developing agent to said component cavity.

2. The cartridge of claim 1 wherein said moving component comprises a drum.

3. The cartridge of claim 2 wherein said drum comprises a photoconductive drum.

4. The cartridge of claim 1 wherein a portion of said transport device is positioned in said cavity of said moving component.

5. The cartridge of claim 1, wherein said transport device is an auger.

6. The cartridge of claim 1 wherein said transport device comprises an auger having a length including flights wherein said auger has an outer diameter wherein said outer diameter varies along the length of said auger.

7. An image forming apparatus comprising a moving component including an end cap having a cavity capable of containing developing agent;

a reservoir for developing agent;

a transport device having a shaft keyed to rotate with said endcap and capable of transporting said developing agent between said reservoir and said cavity of said moving component; and wherein upon rotation of said moving component including said end cap and said shaft keyed to rotate with said end cap said rotation said rotation activates said transport device to transport said developing agent to said component cavity.

8. The image forming apparatus of claim 7 wherein said moving component comprises a drum.

9. The image forming apparatus of claim 8 wherein said drum comprises a photoconductive drum.

10. The image forming apparatus of claim 7 wherein a portion of said transport device is positioned in said cavity of said moving component.

11. The image forming apparatus of claim 7 wherein said transport device is an auger.

12. The image forming device of claim 7 wherein said transport device comprises an auger having a length including flights wherein said auger has an outer diameter wherein said outer diameter varies along the length of said auger.

13. A method for transporting developing agent in an image forming device including a moving component including an end cap having a cavity capable of storing image forming material comprising:

supplying developing agent at a first location in said image forming device; and transporting developing agent from said first location to said cavity of said moving component via a transport device having a shaft keyed to rotate with said end cap wherein upon rotation of said moving component including said end cap and said shaft keyed to rotate with said end cap said rotation activates said transport device to transport said developing agent to said component cavity.

14. The method of claim 13 wherein said moving component comprises a drum.

15. The method of claim 13 wherein said first location comprises a developing agent reservoir.

16. The method of claim 15 wherein said image forming device includes a photoconductive component and removing developing agent from said photoconductive component to supply developing agent to said reservoir.

17. The method of claim 13 wherein said step of moving said moving component comprises moving said component during a step of printing by said image forming device.

18. The method of claim 13 where said developing agent comprises toner.

19. The method of claim 13 wherein said image forming device includes an auger having a length and a plurality of adjacent flights and transporting said developing agent along said flights.

20. The method of claim 13 wherein said transport device comprises an auger having a length including flights wherein said auger has an outer diameter wherein said outer diameter varies along the length of said auger.

* * * * *